US005924965A

United States Patent [19]

Vardy

[11] Patent Number: 5,924,965

[45] Date of Patent: Jul. 20, 1999

[54] METHOD OF EXERCISING THE HUMAN BODY

[76] Inventor: Terence Cecil Vardy, 8 Charlton La., Cudgera, New South Wales, 2484, Australia

[21] Appl. No.: 08/669,137

[22] Filed: Jun. 24, 1996

[30] Foreign Application Priority Data

Jun. 22, 1995 [AU] Australia ..... 23209/95

[51] Int. Cl.[6] ..... A63B 21/00

[52] U.S. Cl. ..... 482/112; 482/113; 482/148; 128/898

[58] Field of Search ..... 482/91, 111, 112, 482/113, 148; 128/898

[56] References Cited

U.S. PATENT DOCUMENTS

| | | | |
|---|---|---|---|
| 3,359,802 | 12/1967 | Sollenberger | 482/113 X |
| 3,424,005 | 1/1969 | Brown | 482/91 X |
| 3,451,271 | 6/1969 | Knoblauch | 482/113 |
| 4,257,593 | 3/1981 | Keiser | 482/113 |
| 4,647,041 | 3/1987 | Whiteley | 482/113 X |
| 4,801,139 | 1/1989 | Vanhoutte | 482/112 |
| 4,969,643 | 11/1990 | Kroeker | 482/91 X |
| 5,653,666 | 8/1997 | Pantoleon | 482/112 |

FOREIGN PATENT DOCUMENTS

| | | | |
|---|---|---|---|
| 1394245 | 5/1975 | United Kingdom | 482/112 |
| 8904695 | 6/1989 | WIPO | 482/113 |

*Primary Examiner*—Richard J. Apley
*Assistant Examiner*—William LaMarca
*Attorney, Agent, or Firm*—Amster, Rothstein & Ebenstein

[57] ABSTRACT

This invention relates to exercise apparatus 210 for exercising the human body 12 and in particular the cardiovascular system and selected muscle groups. The exercise apparatus includes application means 211 for applying a force to a person's body and support means 214 for supporting the person's body in an attitude whereby they may oppose the application of said force.

4 Claims, 8 Drawing Sheets

METHOD OF EXERCISING THE HUMAN BODY

FIELD AND BACKGROUND OF THE INVENTION

This invention relates to exercise apparatus.

This invention has particular but not exclusive application to exercise apparatus which exercises at least some of the major muscle groups of the user's upper or lower body simultaneously and that as a consequence the user is encouraged to perform a valsalva manoeuvre and for illustrative purposes reference will be made to such application. However in addition, it is believed the exercise apparatus may be used to strengthen the cardiovascular system of the human body and/or selected muscles; to enhance the lymphatic and nerve systems; to correct neurological, muscular and vascular abnormalities; to treat medical disorders including Multiple Sclerosis and Chronic Fatigue Syndrome, and for minimising abnormalities in bodily fluid flow and a general loss of mobility and strength exhibited by persons confined to weightless environments such as astronauts.

Exercise apparatus comprising weights which may be lifted or pushed between a steadfast position and a relatively unstable position are known and are often used to exercise or strengthen selected muscles or muscle groups of the human body. Unfortunately the repetitious contraction and extension of various muscles associated with the use of such apparatus places considerable strain on the tendons connecting the muscles to adjacent bones and may contribute to temporary or permanent damage thereto.

It is also apparent that the use of such exercise apparatus will not enable persons to perform a valsalva manoeuvre and as a consequence such apparatus can not be used to raise the pressure of the person's cerebrospinal fluid.

It has also been observed that astronauts who have been subjected to a weightless environment for a prolonged period of time often suffer a loss of muscular strength contributing to a lack of mobility. It is therefore desirable to provide astronauts with exercise apparatus which they may use in weightless environments and preflight so as to maintain acceptable levels of muscular strength and mobility. Present exercise apparatus, being dependent on gravitational forces, are useless in weightless environments.

It has also been observed amongst astronauts that some bodily fluids including blood have an undesirable tendency to shift in a cephalad direction due to the weightless environment. It is therefore desirable to provide apparatus which when used in a weightless environment may arrest or reverse the aforementioned flow of bodily fluids into the thorax and head cavities in particular.

SUMMARY OF THE INVENTION

The present invention aims to alleviate at least one of the aforementioned disadvantages and to provide an exercise apparatus which will be reliable and efficient in use.

With the foregoing in view, this invention in one aspect resides broadly in an exercise apparatus for isometrically exercising a user's large muscle groups including:

support means for supporting the user's body in a desired exercising attitude;

force application means for applying a continuous force to a part of the user's body whereby one or more of the large muscle groups may be employed to resist said force, and positioning means adapted for contact by another part of the user's body for assisting the user to position and maintain said part of the body in a substantially stationary position by limiting movement of said other part.

Preferably the exercise apparatus also includes control means for controlling the application of said force whereby, whilst the user is resisting said force, the magnitude of said force may be progressively increased. Furthermore, it is preferred that the magnitude of the force which may be applied to the user's body is such that in order to resist said force the user must perform a valsalva manoeuvre.

The force applied by the force application means may be gravitational. For example the apparatus may include a plurality of weights which may be selectively used conjunctively in order to increase the magnitude of the force applied to the user's body. Alternatively the apparatus may include a heavy mass and wherein the magnitude of the force applied to the user's body may be varied by selectively reposition all or some of the mass.

However in other embodiments a machine such as a ram or a winch may be used to apply a force to the user's body and wherein the machine may be mechanically, electrically or hydraulically driven.

The support means may include a support assembly for supporting a user in a selected attitude. In one embodiment the support assembly may be adapted to support the user in a substantially recumbent position and may include a platform for supporting the user's back, head and shoulders in a substantially horizontal attitude. Furthermore, the angle of inclination to the horizontal may be variable and the platform may be padded.

In an alternative embodiment the support assembly may be adapted to support a user in a seated attitude and may include a platform on which the user may sit and possibly a back support to support the user's back. The support assembly may also include support means for supporting the user's legs, arms and hands including handles which the user may grasp.

In yet another embodiment the support assembly may be adapted to support the user's body in an upstanding position, such as a forwardly inclined position, and wherein the support assembly may include a platform upon which the user may stand and foot support means for supporting the user's feet. For example, the foot support means may include one or more foot stools upon which the user may rest their feet and wherein both the inclination of the stools and their location relative to the force application means may be variable. The foot support means may also permit movement of the user's feet whilst the user is also resisting forces applied to the user's body by the force application means. Furthermore, movement of the foot support means may be automated and may be controlled by the control means.

The positioning means preferably prevents the user from straightening certain parts of their body and thus assist the user in maintaining a preferred exercising attitude. The positioning means may therefore prevent certain injuries which might otherwise occur if the user were lock his or her skeletal frame in a position so as to resist forces applied to the user's body by the force application means.

The control means may include a trigger or the like which controls the release of gravitational forces. Alternatively, the control means may control the operation of a motor or such like used to drive the force application means. For example, the control means may control the speed at which a motor may operate, the pressure applied to working fluids or the operation of mechanical means used to drive machines adapted to apply compressive or tension forces on the user.

Preferably the control means permits either the user, or persons assisting the user, to regulate, increase or decrease the force applied by the force application means.

The exercise apparatus may further include termination means operable by a user, or a person assisting the user, for terminating the application of forces applied to the user. For example, the termination means may include a switch which terminates or reverses the operation of any motors.

The exercise apparatus may also be provided with safety means which prevents the continued application of forces to the user's body should the user be unable to continue resisting the application of the forces or which enables a user to safely disengage his or her body from the portion of the exercise apparatus through which the forces are applied to his or her body. For example, the apparatus may include stops which limit the operation of the machines in the event that a user ceases resisting the forces applied to his or her body by the apparatus.

For the benefit of the user, the exercise apparatus may also be provided with measuring means for measuring the force applied to the user's body such as a load cell or a pressure gauge.

In a further aspect, this invention resides in a method of exercising the human body, the method including:

providing an exercise apparatus suitable for isometrically exercising a user's large muscle groups, said apparatus having force application means for applying a continuous force to a part of the user's body and support means for supporting the user's body in a desired exercising attitude;

positioning the user on the exercise apparatus such that their body is supported by said support means in a desired exercising attitude, and using said force application means to apply a force to the user's body which the user is required to resist isometrically.

Preferably the magnitude of the force applied to the user's body is progressively increased whereby in order to resist the force, the user is compelled to perform a valsalva manoeuvre, namely to close the glottis and all abdominal orifices thereby closing the thoraco-abdominal cavity resulting in a temporary cessation of breathing, a decrease in the flow of blood from the heart to the lungs and from the lungs to the heart and whereby the resulting rise in pressure in the thoraco-abdominal cavity causes blood to be forced into the vertebral venous plexus thereby raising the pressure of the cerebrospinal fluid.

The closing of the glottis and all abdominal orifices resulting in an increase in pressure within the closed thoraco-abdominal cavity and consequently blood to be forced into the vertebral venous plexus will hereinafter be referred to as a Valsalva manoeuvre.

In a further aspect this invention relates to a method of strengthening the human vascular system, the method including:

providing an exercise apparatus suitable for isometrically exercising a user's large muscle groups, said apparatus having force application means for applying a continuous force to a part of the user's body and support means for supporting the user's body in a desired exercising attitude;

positioning the user on the exercise apparatus such that their body is supported by said support means in a desired exercising attitude, and using said force application means to apply a force to the user's body which the user is required to resist isometrically.

Preferably, the magnitude of the force applied to the user's body is progressively increased whereby in order to resist the force, the user is compelled to perform a valsalva manoeuvre. It is also preferred that the user is positioned or supported by the support assembly in a supine position, ie. the user's head is lower than the user's trunk, or horizontal. When in such a position, it is believed that greater pressure is exerted on the thoraco-abdominal and cranial systems than would exist if the user were horizontal or supported in a position whereby the user's head was elevated above the user's hips. The increase in pressure is believed to effect the arterial, venous, lymph, cerebrospinal and nervous systems.

Multiple sclerosis may be described as a gradual demyelination of cells in the central nervous system (the brain and spinal cord). The myelin sheath which protects the spinal cord often becomes damaged and inflamed and wherein the resulting scar tissue (sclerosis) prevents nerve signals travelling to and from the brain. Often more than one area of the central nervous system is usually affected, hence the name multiple sclerosis.

Persons who are afflicted with multiple sclerosis may experience difficulties with balance, sight, speech, limb movement and certain body functions. The type and degree of disability depends on the parts of the nervous system which is affected.

It is also noted that the degree of disability which persons suffer may vary considerably and may be dependent upon emotional and physical factors such as increased stress levels, physical exercise, foods and a lack of sleep.

By stimulating the pituitary gland the inventor has noted a lessening of the degree of disability of persons suffering from multiple sclerosis.

Thus in yet another aspect, this invention relates to a method of stimulating the pituitary gland, the method including:

providing an exercise apparatus suitable for isometrically exercising a user's large muscle groups, said apparatus having force application means for applying a continuous force to a part of the user's body and support means for supporting the user's body in a desired exercising attitude:

positioning the user on the exercise apparatus such that their body is supported by said support means in a desired exercising attitude, and using said force application means to apply a fore to the user's body which the user is required to resist isometrically.

Preferably the magnitude of the force applied to the user's body is progressively increased whereby in order to resist the force, the user is compelled to perform a valsalva manoeuvre.

It has also been observed that due to unopposed or unequal pressures within the body, such as may exist due to a lack of use of portions thereof which is typical of persons afflicted with multiple sclerosis, fluids including blood may leak into cephalad vessels and tissues causing undesirable physiological changes to the human body. It is also noted that decreases in the gravitational force exerted on the human body also results in unequal or unopposed pressures within tissues of the body resulting in an undesirable build up of body fluids in the cavities of the body. However, by performing a Valsalva manoeuvre at least some of the offending body fluids may be expelled from the body's cavities.

Accordingly, in yet another aspect, this invention relates to a method of expelling body fluids from cavities of the human body, the method including:

providing an exercise apparatus suitable for isometrically exercising a user's large muscle groups, said apparatus having force application means for applying a continuous force to a part of the user's body and support means for supporting the user's body in a desired exercising attitude;

positioning the user on the exercise apparatus such that their body is supported by said support means in a desired exercising attitude, and using said force application means to apply a force to the user's body which the user is required to resist isometrically.

Preferably the magnitude of the force applied to the user's body is progressively increased whereby in order to resist the force, the user is compelled to perform a valsalva manoeuvre.

It has also been observed that persons exposed to weightless environments have suffered from ischemia, a loss of calcium and bone density and that the bones which make up the human skeleton do not acquire calcium except when accompanied by heavy physical overload.

In yet another aspect this invention relates to a method of applying a force to selected bones of the human body, the method including:

providing an exercise apparatus suitable for isometrically exercising a user's large muscle groups, said apparatus having force application means for applying a continuous force to a part of the user's body and support means for supporting the user's body in a desired exercising attitude;

positioning the user on the exercise apparatus such that their body is supported by said support means in a desired exercising attitude, and using said force application means to apply a force to the user's body which the user is required to resist isometrically.

Preferably the magnitude of the force applied to the user's body is progressively increased whereby in order to resist the force, the user is compelled to perform a valsalva manoeuvre. It is also preferred that the force applied to the body is such that at least a component thereof is applied axially to selected bones of the user's body.

BRIEF DESCRIPTION OF THE DRAWINGS

In order that this invention may be more readily understood and put into practical effect, reference will now be made to the accompanying drawings which illustrate a typical embodiment of the invention and wherein.

DESCRIPTION OF THE PREFERRED EMBODIMENTS

Figure 1:
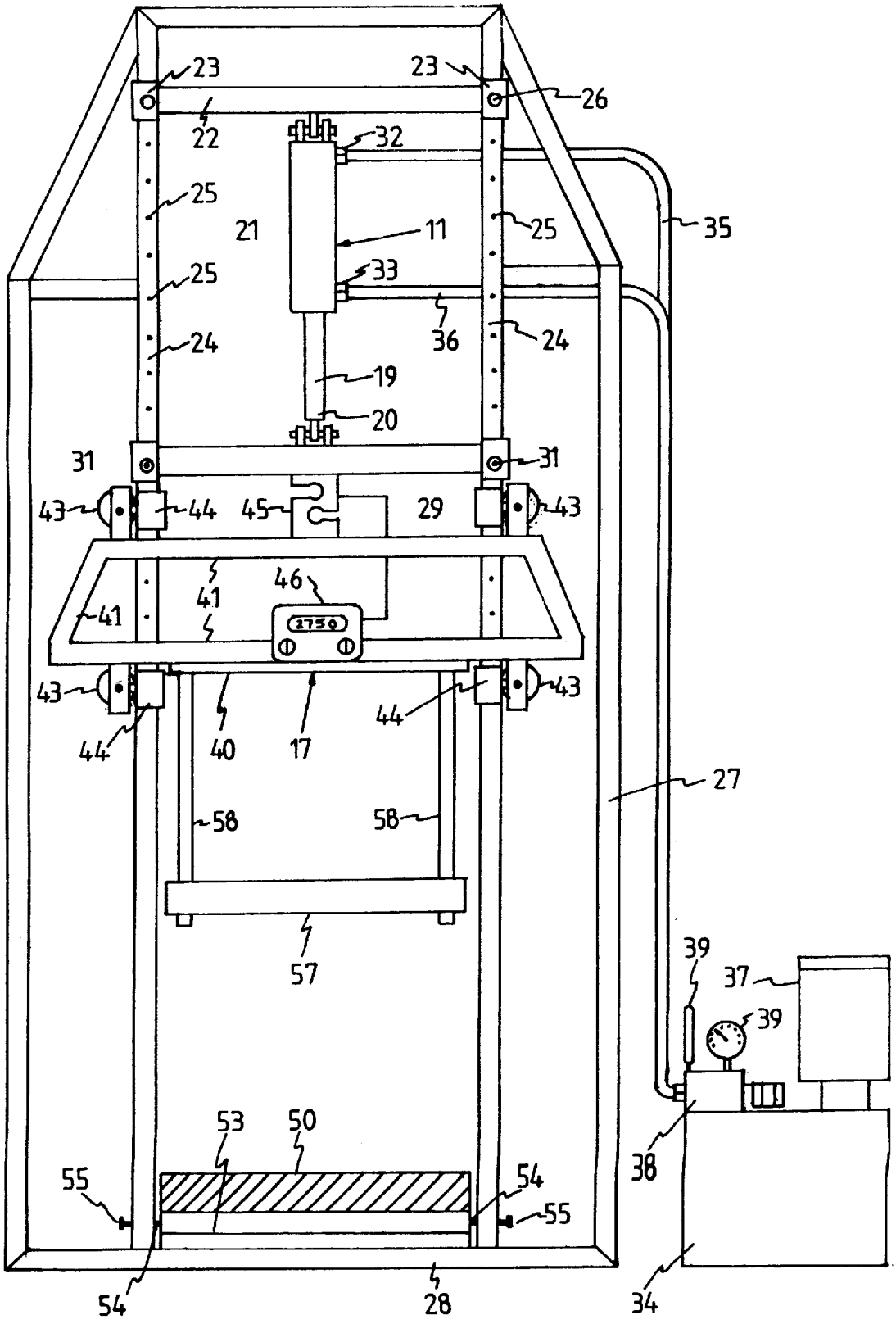
FIG. 1 is an end view of exercise apparatus constructed in accordance with the present invention.
Figure 2:
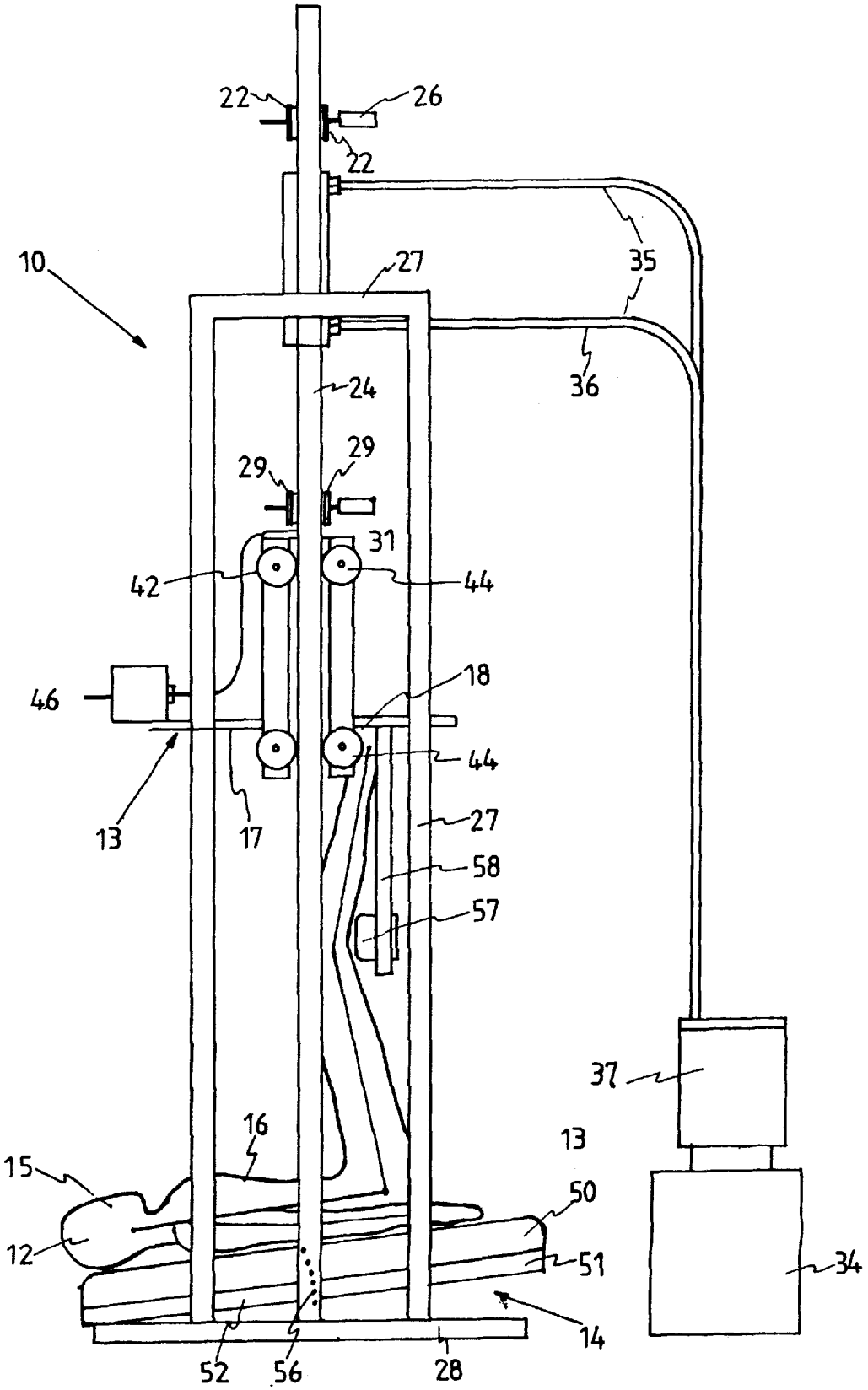
FIG. 2 is a side view of the exercise apparatus illustrated in FIG. 1.

FIGS. 1 and 2 illustrate an exercise apparatus 10 including application means 11 for applying a force to a user's body 12 maintained in a force opposing attitude by support means 13 including a support assembly 14 supporting the user's head 15 and trunk 16 in a supine position and bearing means 17 against which the user's feet 18 abut.

The application means 11 includes a vertically orientated hydraulic ram 19 having a lower end 20 coupled to the bearing means 17 and an upper end, not shown, which is retained within a cylindrical housing 21.

The housing 21 depends from a pair of opposing, horizontally disposed, frame members 22 each having opposing ends 23 which are each releasably pinned to a respective upstanding frame member 24 having a plurality of apertures 25 formed therein along an upper portion thereof using pins 26. The upstanding frame members 24 are each supported by a bracing assembly 27 and a rectangular frame assembly or base 28.

The lower end 20 of the ram 19 is coupled to a pair of opposing, horizontally disposed, frame members 29 each having opposing ends 30 which may be selectively pinned to respective frame members 24 using pins 31.

The housing 21 includes an inlet port 32 and an outlet port 33 each fluidly connected to a fluid container 34 by respective inlet and outlet pressure hoses 35 and 36 respectively. The application means further includes a hydraulic pressure motor 37, mounted on and operatively connected to the fluid container 34 whereby in use the motor 37 drives the fluid contained in the container 34 through hose 35 into an upper chamber of the housing 21 resulting in downward movement of the ram 19. The motor 37 is actuated by an on/off switch not shown and wherein the pressure under which the fluid is delivered to the ram 19 is controlled by control means comprising a pressure regulator assembly 38 having a control lever 39 and a pressure gauge 39*a*.

The bearing means 17 includes a base plate 40 which is supported by a frame assembly 41 slidably mounted on upstanding frame members 24 and wherein the frame assembly 41 is provided with roller assemblies 42, 43 and 44 which bear against front, side and rear faces of each frame member 24 respectively. The bearing means 17 further includes a load cell assembly 45 having a digital display 46 and wherein the load cell assembly 45 is located intermediate and is operatively connected to the frame assembly 41 and the frame members 29.

The support assembly 14 includes a padded platform 50 supported by a rectangular frame assembly 51 comprising a pair of opposing longitudinal frame members 52 and a pair of opposing transverse frame members 53. Each longitudinal frame member 52 includes an aperture 54 formed partway along the length thereof and wherein the fame assembly 51 may be supported in an inclined attitude by a pair of pins 55 each of which extend through respective aligned apertures 56, formed in the frame members 24 near the lower end thereof, and apertures 54.

The exercise apparatus also includes positioning means including a padded, horizontally disposed, frame member 57 which is supported by a pair of vertically orientated frame members 58 which extend downwardly from the base plate 40. The frame member 57 is locatable behind a user's knee joints and wherein in use the frame member prevents the user from straightening their legs and thus assists the user to maintain a preferred exercising attitude. The positioning means may therefore prevent certain injuries which might otherwise occur if the user were to lock his or her skeletal frame in a position so as to resist forces applied to the user's body by the force application means.

Figure 3:
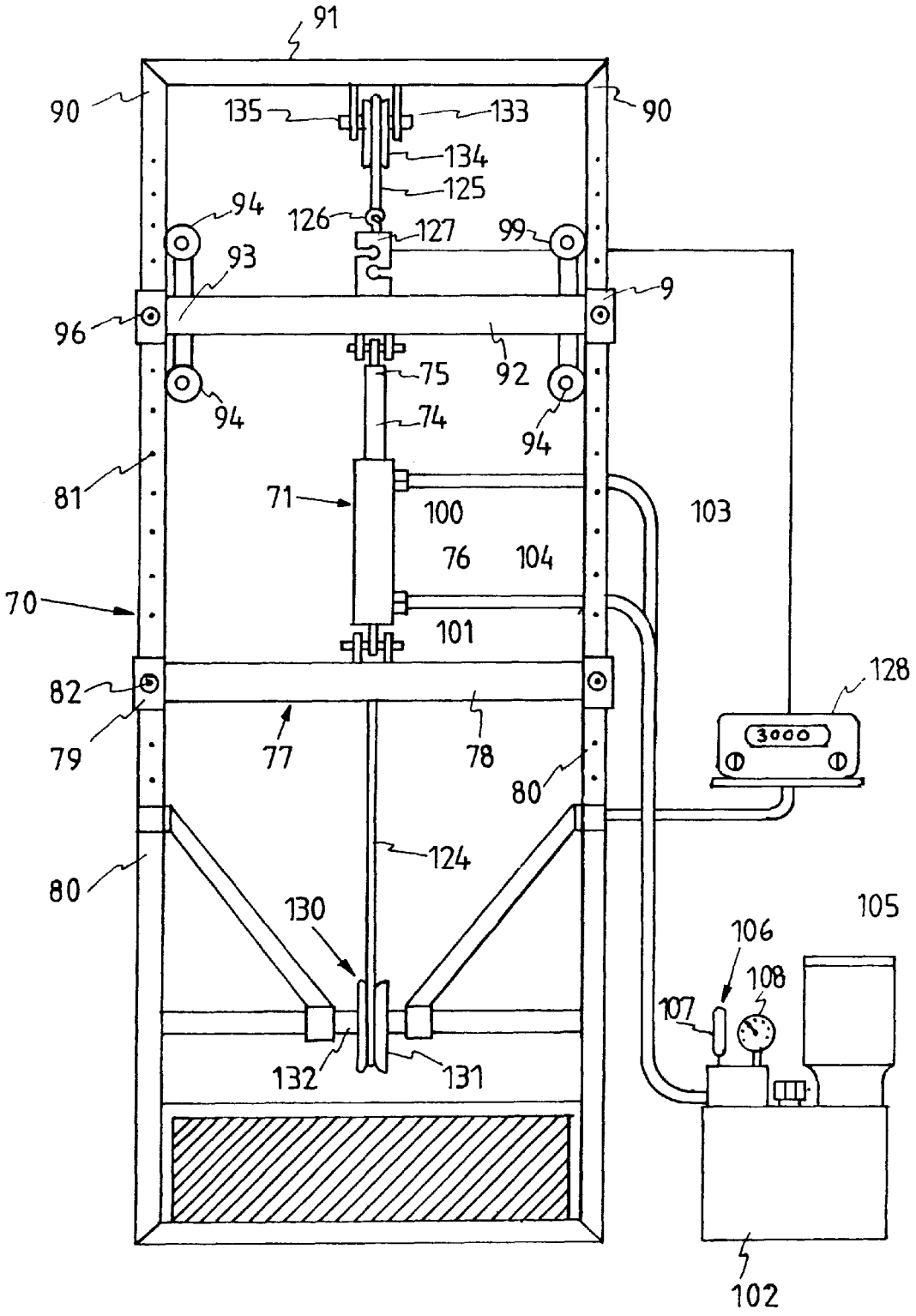
FIG. 3 is an end view of another exercise apparatus constructed in accordance with the present invention.
Figure 4:
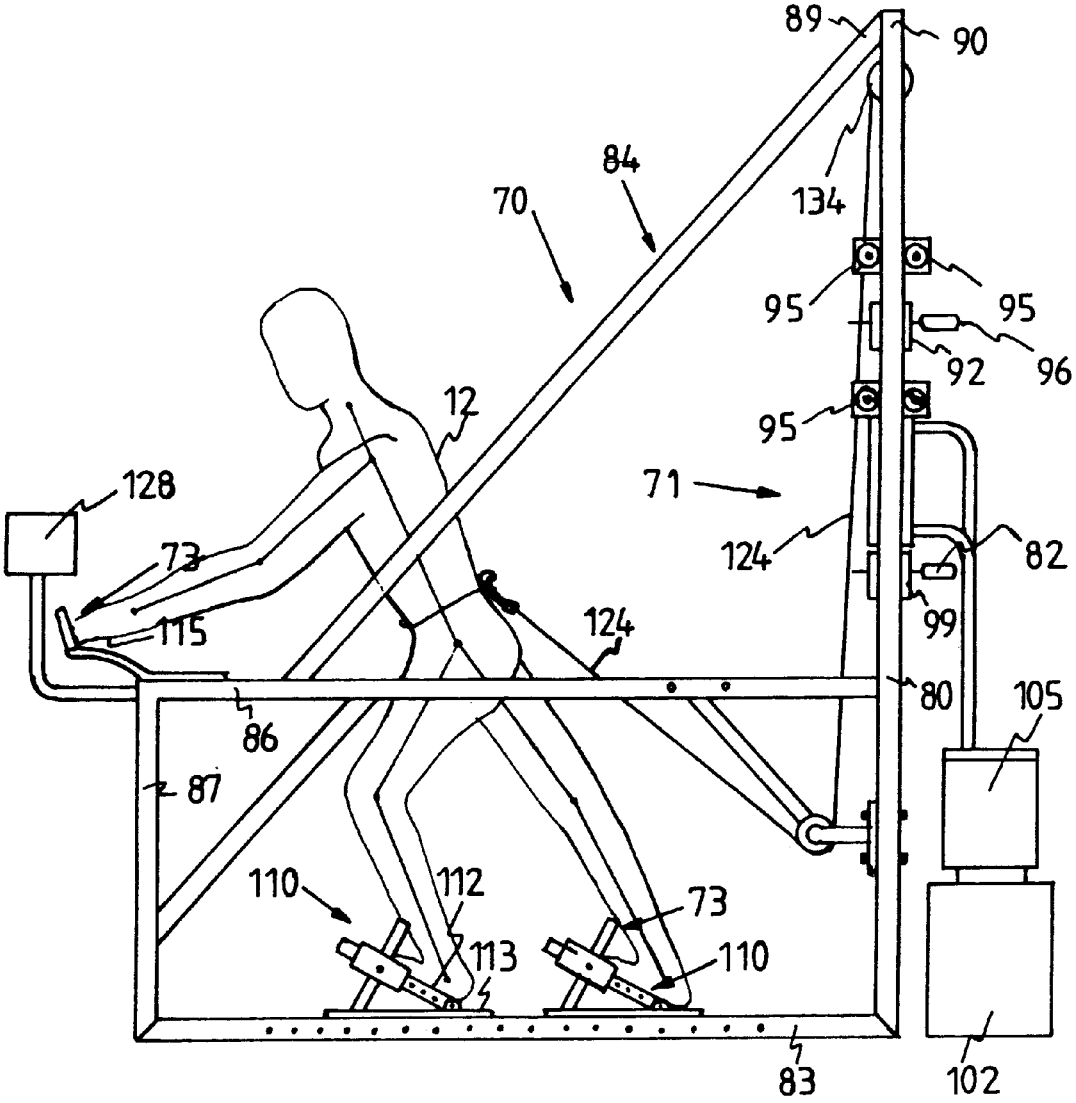
FIG. 4 is a side view of the exercise apparatus illustrated in FIG. 3.

FIGS. 3 and 4 illustrate an exercise apparatus 70 including application means 71 for applying a force to a user's body 12 maintained in a force opposing attitude by support means 72 including a support assembly 73 supporting the user's body in an upstanding, forwardly inclined position.

The application means 71 includes a vertically orientated hydraulic ram 74 having an upper end 75 and a lower end, not shown, which is retained within a cylindrical housing 76. The housing 76 is coupled to a ram mounting assembly 77 comprising a pair of opposing, horizontally disposed, frame members 78 each having opposing ends 79 which are releasably pinned to a respective upstanding frame member 80, having a plurality of apertures 81 formed therein along an upper portion thereof, using pins 82.

The upstanding frame members 80 extend upwardly from a base comprising a rectangular frame assembly 83 and are each supported by a respective bracing assembly 84. Each bracing assembly 84 includes a horizontally disposed frame member 85, which extends outwardly from frame member 80, having a remote end 86 which is supported by an upstanding frame member 87, and wherein the frame member 85 supports an inclined frame member 88 having an upper end 89 which is attached to the upper end 90 of the frame member 80. The upper ends 90 of the frame members 80 are further connected to an intermediate frame member 91.

The upper end 75 of the ram 74 is coupled to a pair of opposing, horizontally disposed, frame members 92 which are slidably mounted on frame members 80 and wherein the ends 93 of each frame member 92 include roller assemblies 94 and 95 which bear against an internal face and either a forward or rear face of a frame 80. The opposing ends 93 of each frame member 92 may also be selectively pinned to respective frame members 80 using pins 96.

The housing 76 includes an inlet port 100 and an outlet port 101 each fluidly connected to a fluid container 102 by respective inlet and outlet pressure hoses 103 and 104 respectively. The application means 71 further includes a hydraulic pressure motor 105, mounted on and operatively connected to the fluid container 102 whereby in use the motor 105 drives the fluid contained in the container 102 through hose 103 into an upper chamber of the housing 76 resulting in a downward movement of the ram 74. The motor 105 is actuated by an on/off switch, not shown, and wherein the pressure under which the fluid is delivered to the ram 74 is controlled by control means comprising a pressure regulator assembly 106 having a control lever 108 and a pressure gauge 109.

The user 12 is supported by a support assembly 73 which includes a pair of foot supports 110 each mounted, one behind the other, on opposing longitudinal frame members 111 of the base assembly 83. Each foot rest 110 includes a foot plate 112 having a lower transverse edge hingedly connected to a base plate 113 which is supported at each end by opposing longitudinal frame members 111. Each foot plate 112 is supported in an inclined position by inclined bracing members located at opposing ends thereof and which are selectively pinned thereto.

The exercise apparatus also includes positioning means including a pair of handles 115 each mounted on a respective end 86 of a respective frame member 85. The positioning means prevents the user from straightening certain parts of their body and thus assists the user to maintain a preferred exercising attitude. The positioning means may therefore prevent certain injuries which might otherwise occur if the user were lock his or her skeletal frame in a position so as to resist forces applied to the user's body by the force application means.

The user 12 is provided with a harness or belt 120 which may be worn about the user's trunk 121. A hook 122 is used to releasably connect the harness 120 to an end 123 of a cable 124. The opposing end 125 of the cable 124 includes an eye which is adapted to engage a hook 126 extending upwardly from a load cell 127 mounted on frame members 92. The load cell 127 includes a digital display 128.

The cable 124 is supported by a lower pulley assembly 130 including a pulley wheel 131 rotatably mounted on a shaft 132 mounted intermediate the lower portions of frame members 80. The cable 124 is also supported by an upper pulley assembly 133 including a pulley wheel 134 rotatably mounted on a shaft 135 suspended from frame member 91.

Figure 5:
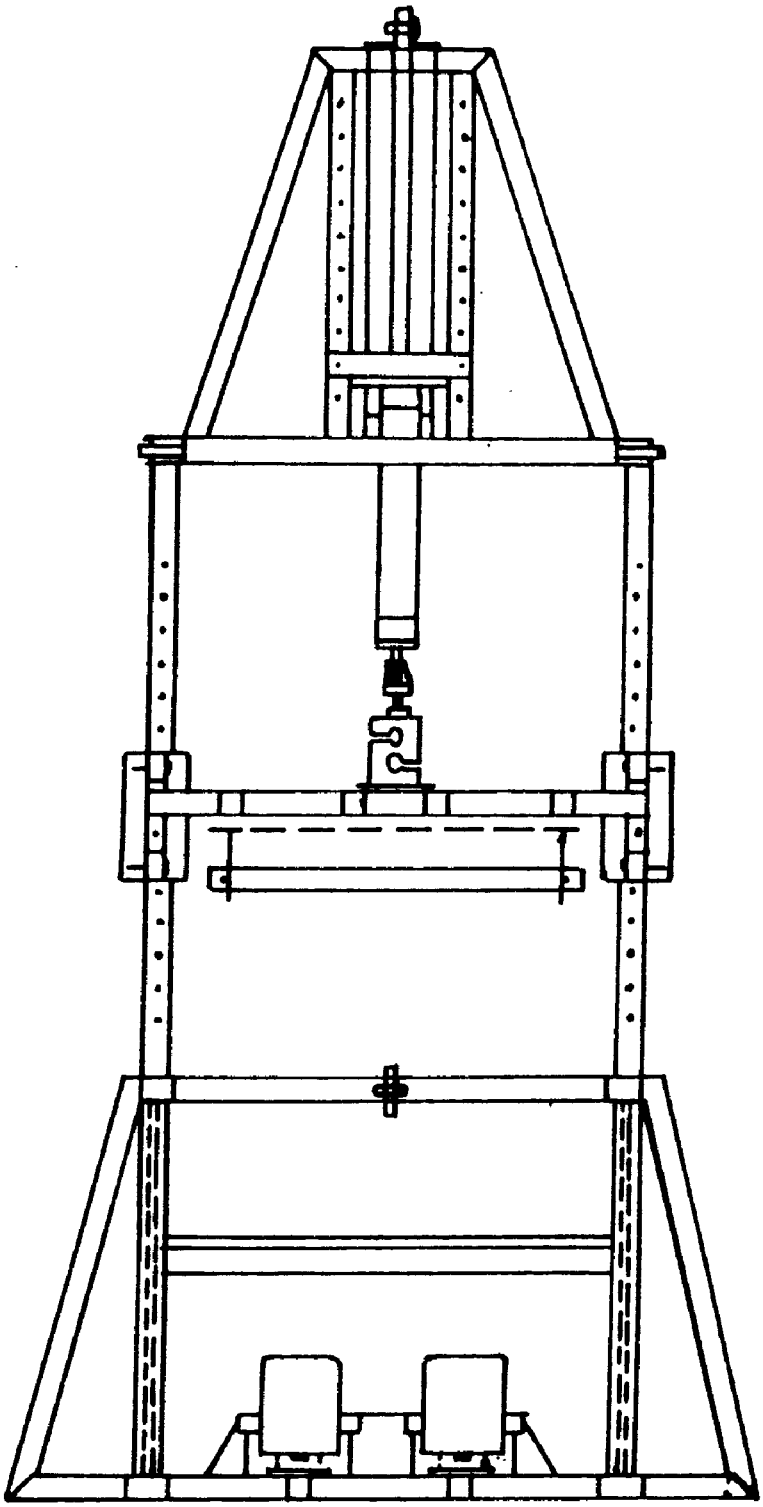
FIG. 5 is a front view of yet another exercise apparatus constructed in accordance with the present invention.
Figure 6:
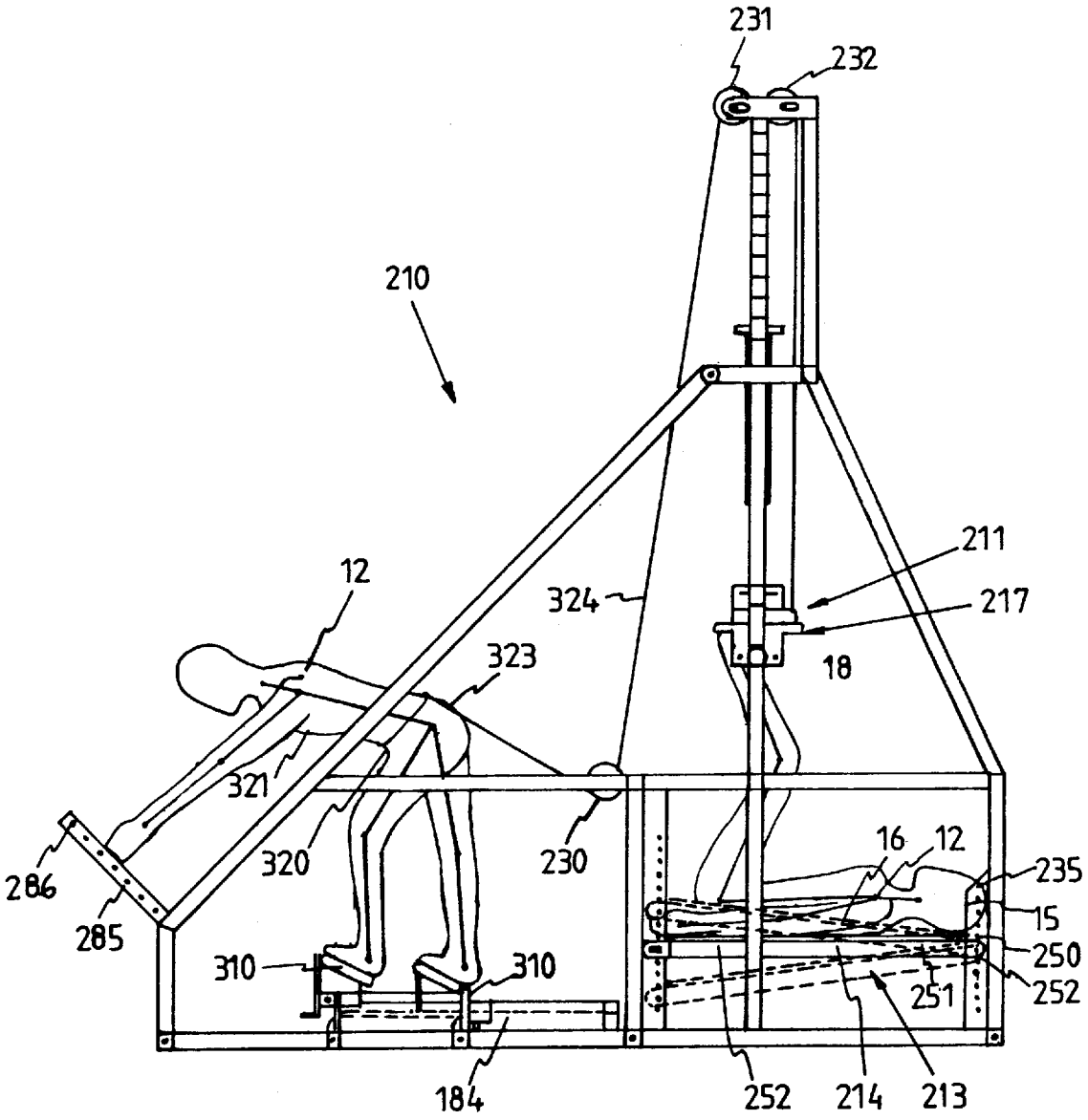
FIG. 6 is a side view of the exercise apparatus illustrated in FIG. 5.

FIGS. 5 and 6 illustrate an exercise apparatus 210 including application means 211 for applying a force to a user's body 12 which is maintained in a force opposing attitude by support means 213 including a user support assembly 214 supporting the user's head 15 and trunk 16 in a supine position and bearing means 217 against which the user's feet 18 abut.

The application means 211 includes a vertically orientated hydraulic ram 219 having a lower end 220 coupled to the bearing means 217 and an upper end, not shown, which is retained within a cylindrical housing 221.

The housing 221 depends from a pair of opposing, horizontally disposed, frame members 222 each having opposing ends 223 which are each releasably pinned to a respective upstanding frame member 224 having a plurality of apertures 225 formed therein along an upper portion thereof using pins.

As previously mentioned, the lower end 220 of the ram assembly 219 is operatively coupled to bearing means 217 having mounting means 229 associated with opposite ends thereof. The mounting means 229 includes rollers which permit sliding movement of the mountings 229 relative to respective upstanding guide frame members. The mountings 229 may be selectively pinned to respective frame members 224 using pins which are also locatable within selected apertures 231 extending upwardly along the length of the guide frame members 209.

The housing 221 includes an inlet port and an outlet port each fluidly connected to a fluid container by respective inlet and outlet pressure hoses respectively. The application means 211 further includes a hydraulic pressure motor, operatively connected to the fluid container and whereby in use the motor supplies the fluid contained in the container, via the inlet hose to an upper chamber of the housing 221 thereby resulting in downward movement of the ram 219. The motor is preferably actuated by an on/off switch and wherein the pressure under which the fluid is delivered to the ram assembly 219 is preferably controlled by control means comprising a pressure regulator assembly.

The bearing means 217 includes a base plate 240 which is supported by plate support means 241 attached to said mountings 229 and which as a consequence may move in a generally vertical direction relative to the guide frame members 209.

Figure 8:
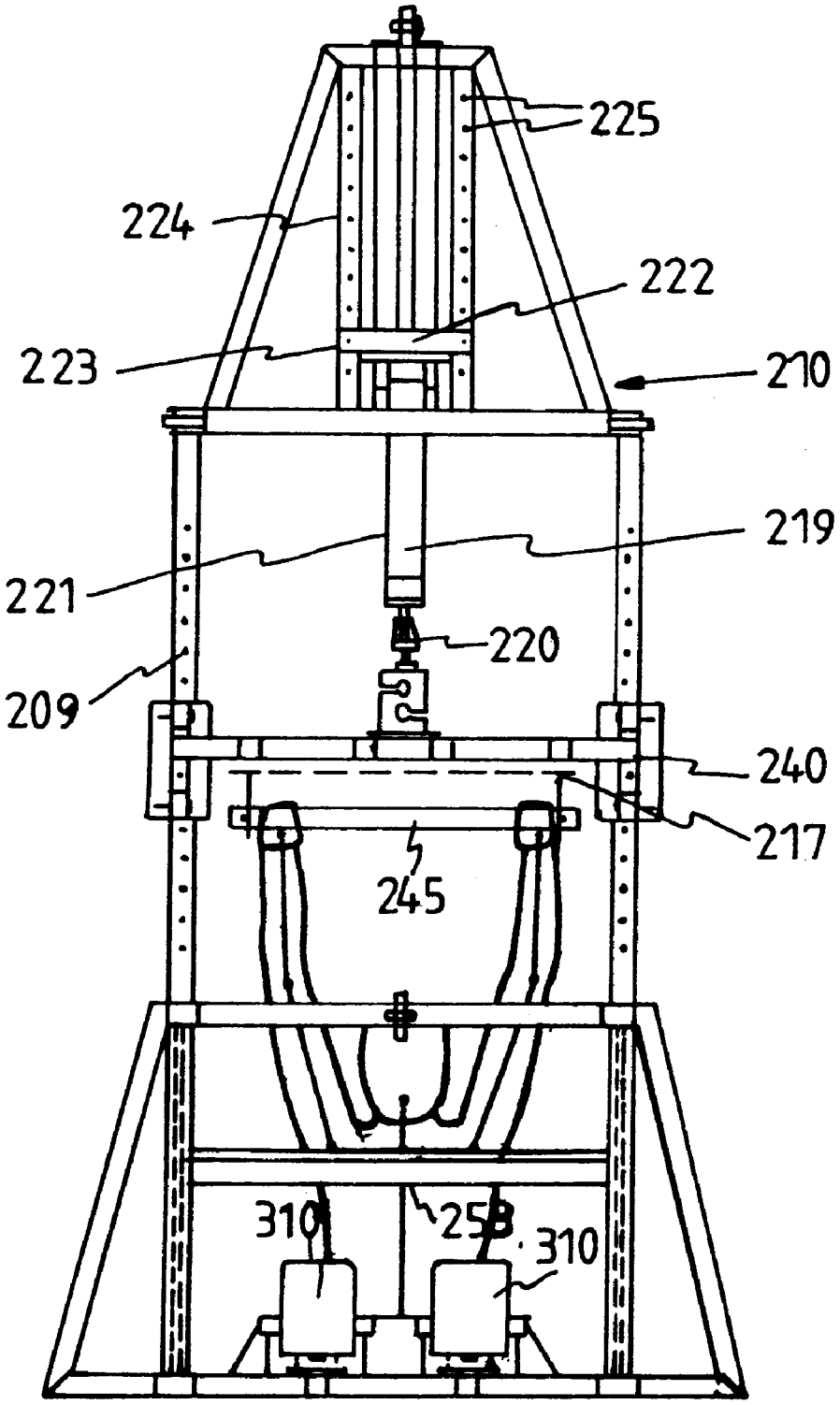
FIG. 8 is a front view of the exercise apparatus illustrated in FIG. 5.

The bearing means 217 also includes a bar 245 which depends from the base plate 240 and which is detachably mounted thereto. The bar may provide a user supported by said user support assembly 213 with something to grip with his or her hands and wherein the configuration is such that a user may use his or her arms to resist forces applied to the user's body by the application means 211, see FIG. 8.

The user support assembly 214 includes a padded platform or cushion 250 supported by a rectangular frame assembly 251 comprising a pair of opposing longitudinal frame members 252 and a pair of opposing transverse frame members 253. The ends 252*a* of each longitudinal frame member 252 include an aperture 254 formed therein and wherein the fame assembly 251 may be releasably secured to upstanding frame members 235, each having a plurality of apertures 256 formed therein, by extending pins through respective pairs of aligned apertures 254 and 256.

It will be appreciated that the construction of the user support assembly and the application means enables the user to selectively position the height of the user support assembly and the application means above the floor to suit his or her body dimensions. It will also be appreciated that the construction of the user support assembly also permits the user to selectively arrange the frame assembly 250 such that the user will be supported in a position wherein his or her head lies below, level with or above their hips.

Figure 7:
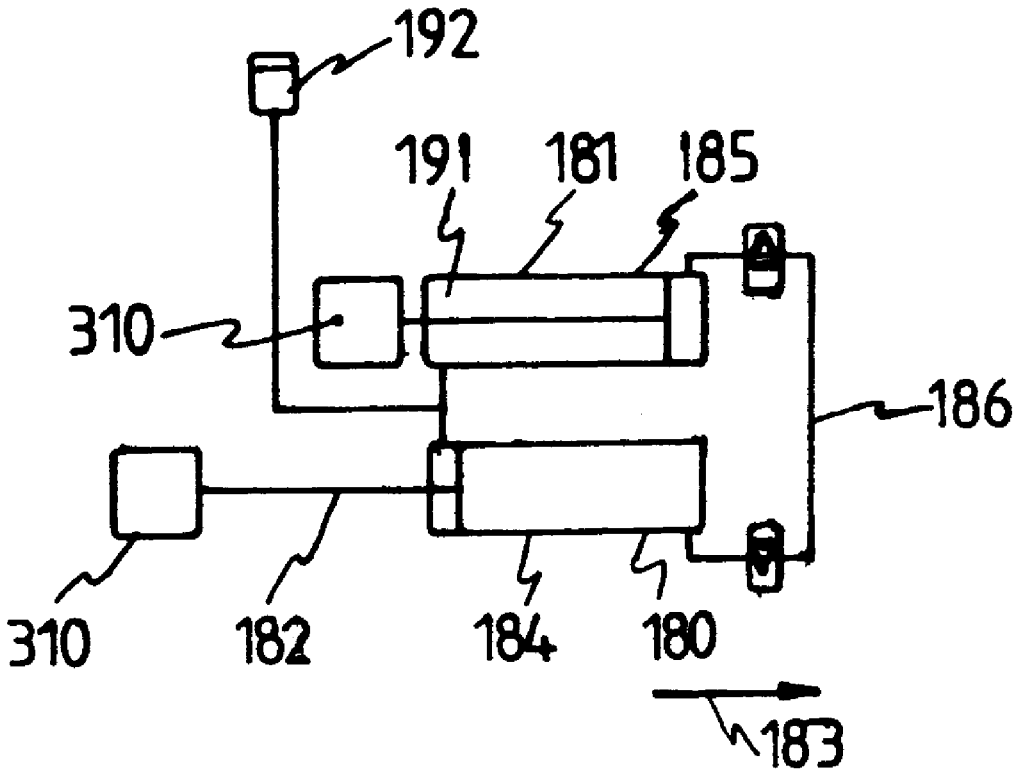
FIG. 7 is a schematic illustration of a hydraulic circuit.

The exercise apparatus 210 is also provided with a second user support assembly 273 which is adapted to support a user's body in a generally upstanding, forwardly inclined position. The user support assembly 273 includes a pair of foot supports 310 arranged side by side and slidably mounted on respective guide assemblies or rails mounted on a base frame assembly of the exercise apparatus 210. Each foot support is attached to a respective hydraulic ram assembly 180 and 181 and wherein the hydraulic circuit is illustrated schematically in FIG. 7 and wherein the hydraulic circuit is adapted to provide resistance to the sliding movement of the user's back and forth. In particular, when the ram 182 moves in the direction of arrow 183, fluid is discharged from the cylinder 184 into cylinder 185 by way of connecting hose 186. The hose 186 is punctuated by two valve assemblies 187 which provide resistance to the flow of fluid through the hose 186.

Similarly, the fluid retained behind the piston 188 contained within cylinder 181 is discharged therefrom into cylinder 182, behind the piston 189, via a connecting hose 190, which is in fluid connection with a reservoir 192.

It will be appreciated that the converse applies when the user's feet change direction and the ram 191 is driven in the direction of arrow 183.

It is believed that repeated movement of the user's legs in a forward and backward direction, when engaging respective supports 310, will enhance the user's proprioceptive ability.

The user support assembly 273 further includes a pair of handles 315 each mounted on a respective end 286 of a respective frame member 285.

The user 12 is provided with a harness or belt 320 which may be worn about the user's trunk 121. A hook is used to releasably connect the harness 320 to an end 323 of a cable 324. The opposing end 325 of the cable 324 is operatively connected to the application means 211. The cable is supported intermediate its two ends by a lower pulley assembly 330, and two upper pulley assemblies 331 and 332.

In the case of the apparatus illustrated in FIGS. 1 and 2, in use, a user is positioned on the padded platform 50 such that the user's head is lower than the user's trunk and wherein the user's outstretched legs extend upwardly in the direction of the ram 19.

Depending upon the length of the user's legs, the height of the ram assembly is adjusted such that, when the ram 19 is in a fully retracted position relative to the housing 21, the user's feet abut the base plate 40 when the user's legs are at least partially bent at the knee joint. Preferably during use, the padded platform 57 prevents straightening of the user's legs.

Having located the ram assembly relative to the user's body 12, pins 26 may be extended through aligned apertures 23*a* and 25 so as to secure frame members 22 to upstanding frame members 24. It should be noted that the bearing assembly is free to travel along the length of the frame members 24 and that pins 31 have been temporarily discarded.

An assistant/trainer may then actuate the hydraulic motor 37 so as to drive fluid contained in the container 34 into the housing 21 via hose 35. The resulting hydraulic pressure within the housing 21 drives the ram 19 and the bearing plate 40 coupled thereto in a downward direction.

In use, the user is required to resist the downward movement of the bearing plate 40 with his or her legs with an equal and opposite force. The pressure at which the fluid is delivered to the housing 21, and hence the force exerted on the user, is increased using the pressure regulator assembly 38 until the situation exists whereby in order to resist the force applied to his or her body the user is required to perform a Valsalva manoeuvre.

It will be appreciated that such a situation cannot be maintained indefinitely and the resistance of large forces can only be brief and intense.

Eventually the user will be unable to resist the forces applied to his or her body and as a consequence will be forced to retract his or her legs. The bearing plate however is prevented from crushing the user's body by the length of the ram 19.

With regard to exercise apparatus 70, a user may be positioned thereon in an upstanding, forwardly inclined, attitude such that the user's feet are each positioned on a respective inclined footrest 110 and wherein the user's hands are used to grip respective handles 115.

The user is also provided with a harness or belt 120 which he or she may wear about their waist.

The height of the ram assembly is adjusted such that when the ram is fully extended, there is little or no slack in the cable 124.

Having located the ram assembly relative to the user's body 12, pins 82 may be extended through aligned apertures 81 and 82*a* so as to secure frame members 78 to upstanding frame members 80.

It should be noted that frame members 92 are free to travel along the length of frame members 81 and that the pins 96 have been temporarily discarded.

An assistant/trainer may the actuate the hydraulic motor 105 so as to drive fluid contained in container 102 into the housing 76 via hose 103. The resulting hydraulic pressure within the housing 76 drives the ram 74 in a downward direction. The movement of the ram 74 applies a tension force to the cable 124 which tends to pull the user backward. In use, the user 12 is required to resist the tension force by pulling on the cable with an equal and opposite force.

The pressure at which the fluid is delivered to the housing 76, and hence the force exerted on the user, is increased using the pressure regulator assembly 106 until the situation exists whereby in order to resist the force applied to his or her body, the user is required to perform a Valsalva manoeuvre.

In use, the maximum force resisted by the user is measured by the load cell 45 or 127 and is displayed on the digital display 46 or 128.

It will be appreciated that the exercise apparatus 10 and 70 may be used to strengthen the vascular system of the body as opposed to peripheral muscular pumping. Increasing the body's ability to resist forces applied thereto (eccentric strength) enables a rapid increase in the amount of weight the body can lift (concentric strength). Furthermore, experiments have shown that the concentric upper limits of the human body can be increased towards the limit which a person can support eccentrically. It has also been observed that even after 12 to 18 months of non-activity a user's strength remains the same as previously attained levels of strength.

It will also be appreciated that by inserting pins 31 through aligned apertures 29*a* and 25, so as to secure frame members 29 to frame members 24, the force exerted by a user on the fixed base plate 40 may also be measured using the load cell 45.

Similarly, by inserting pins 96 through aligned apertures 96*a* and 81, the user may exert a tension force may on the fixed frame members 92 and wherein the force may be measured by the load cell 127.

It will be appreciated that the exercise apparatus illustrated in FIGS. 5 and 6 is in essence a combination of the respective apparatus illustrated in FIGS. 1 and 2 and 3 and 4 and wherein the respective components of the apparatus 210 will operate in a similar manner to the apparatus 10 and 70.

It will of course be realised that while the above has been given by way of illustrative example of this invention, all such and other modifications and variations thereto as would be apparent to persons skilled in the art are deemed to fall within the broad scope and ambit of this invention as is herein set forth in the appended claims.

I claim:

1. A method of exercising the human body, the method including;

providing an exercise apparatus suitable for isometrically exercising a user's large muscle groups, said apparatus having a force application means for applying a continuous force to a part of the user's body, control means for varying the magnitude of the force, and support means for supporting the user's body in a desired exercising attitude;

positioning the user on the exercise apparatus such that the users's body is supported by said support means in a desired exercising attitude; using said force application means to apply a continuous force to the user's body which the user is required to resist isometrically; and using the control means to progressively increase the magnitude of the force while the force is being continuously applied to the user's body, and while the user is resisting said force, the magnitude of said force is progressively increased so that in order for the user to resist said force the user is compelled to perform the valsalva manoeuvre.

2. A method of exercising the human body as claimed in claim 1, wherein the magnitude of the force applied to the user's body is progressively increased whereby in order to resist the force, the user is compelled to perform an involuntary valsalva manoeuvre closing the glottis and all abdominal orifices thereby closing the thoraco-abdominal cavity resulting in a temporary cessation of breathing, a decrease in the flow of blood from the heart to the lungs and from the lungs to the heart and whereby the resulting rise in pressure in the thoraco-abdominal cavity causes blood to be forced into the vertebral venous plexus thereby raising the pressure of the cerebrospinal fluid.

3. A method of exercising the human body to perform the valsalva manoeuvre in order to strengthen the human vascular system, stimulate the human pituitary gland, expel body fluids from cavities of the human body, and apply a force to selected bones of the human body, the method including:

providing an exercise apparatus suitable for isometrically exercising a user's large muscle groups, the apparatus having force application means for applying a continuous force to a part of the user's body, control means for varying the magnitude of the force, and support means for supporting the user's body in a desired exercising attitude;

positioning the user on the exercise apparatus such that the user's body is supported by the support means in a desired exercise attitude;

using the force application means to apply a continuous force to the user's body which the user is required to resist isometrically; and using the control means to progressively increase the magnitude of the force while the force is being continuously applied to the user's body, and while the user is resisting said force, the magnitude of said force is progressively increased so that in order for the user to resist said force the user is compelled to perform the valsalva manoeuvre.

4. A method of exercising the human body as claimed in claim 2, wherein the support means is adapted to support the user on his back and includes rests which prevent the user from straightening his legs when used to resist the force applied to the user's body.

* * * * *